United States Patent [19]

Grenfell et al.

[11] 4,184,728

[45] Jan. 22, 1980

[54] COAXIAL SEAL AND TIP OFF BURNERS

[75] Inventors: Julian P. Grenfell, Woking; Stanley W. Stephens, Lightwater, both of England

[73] Assignee: Badalex Limited, Waybridge, England

[21] Appl. No.: 865,576

[22] Filed: Dec. 29, 1977

[30] Foreign Application Priority Data

Jan. 24, 1977 [GB] United Kingdom ..... 2689/77

[51] Int. Cl.[2] ..... H01J 9/34; H01J 9/38

[52] U.S. Cl. ..... 316/31; 316/30

[58] Field of Search ..... 316/30, 31, 19, 27; 29/25.19

[56] References Cited

U.S. PATENT DOCUMENTS

| | | | |
|---|---|---|---|
| 2,225,090 | 12/1940 | Wiener | 316/31 X |
| 2,531,008 | 11/1950 | Stuart | 316/31 X |

*Primary Examiner*—Richard B. Lazarus

*Attorney, Agent, or Firm*—Thomas J. Greer, Jr.

[57] ABSTRACT

A head for a rotary turret machine for making incandescent lamps or fluorescent light tubes is capable of, sequentially, sealing a mount to the lamp envelope, exhausting the interior of the envelope, filling it with a fill gas and tipping-off the exhaust tube of the mount. The head accordingly includes a sealing burner, a tip-off burner disposed coaxially within the sealing burner and around the exhaust tube with the lead-in wires disposed between the sealing and tip-off burners, a coupling connectable to a vacuum pump or to a source of fill gas, and respective fuel pipes for the sealing and tip-off burners.

10 Claims, 5 Drawing Figures

COAXIAL SEAL AND TIP OFF BURNERS

BACKGROUND OF THE INVENTION

1. Field of the Invention

The present invention relates to an improved method of, and apparatus for, making electric light sources and discharge lamp; more particularly, but not exclusively, electric incandescent lamps and tubular fluorescent lamps.

2. Description of the Prior Art

To put the invention and its advantages as relating to fluorescent lamps into proper context, it is considered helpful briefly to recount the essential structure of a conventional fluorescent lamp tube and conventional automatic machinery for manufacturing such tubes.

A fluorescent lamp is normally a relatively long tubular envelope made of glass. A phosphor coating is baked on the inner wall of the envelope. A glass mount assembly is sealed to each end of the elongated tubular envelope. The tube contains mercury vapour and an inert gas such as argon at low pressure so that on energization of the cathodes carried by the mount assemblies a low pressure mercury vapour discharge is created inside the tube to emit ultra-violet radiation which in turn excites the phosphor on the tube wall to fluoresce and to emit visible light. The electrodes are connected to an external ballasted electrical circuit via a cap fixed to each end of the lamp.

The mount assembly has a stem which includes a pinch, a conical flare the widest region of which is to be sealed to the end of the tube, and (at at least one end, but nowadays usually at both ends) a central, slender, hollow, exhaust tube communicating with the interior of the tube so that air and other undesired gases may be exhausted therefrom and selected fill gas(es) at a desired low pressure may be introduced thereinto before finally hermetically sealing the lamp tube by fusing the exhaust tube, known as tipping-off. For the electrical connection of cathode to the external electrical circuit lead-in wires pass through and are sealed in the mount. The cathode is usually surrounded by an anti-sputtering shield supported by a stay wire also sealed in the pinch. In certain more recent constructions the shield also carries a mercury dispenser which releases a predetermined amount of mercury into the "atmosphere" of the tube interior when indirect, external heating is applied to it.

A conventional automatic machine group for making fluorescent tubes may comprise two stem-making machines and mount mills for assembling together the whole mount assembly with the lead-in wires sealed in place, conveyors for passing the mount assembly to a sealing machine which also receives hollow lamp tubes from a so-called lehr where the phosphor is baked onto the inner wall of the tubes, at an elevated temperature.

Known sealing machines are rotary turrent machines or conveyor machines rotatable either about a vertical or a horizontal axis, intermittently or continuously, and having a plurality of heads for sealing a mount assembly to each end of the tube. In a vertical sealing machine this is done by holding the tube with its axis vertical, sealing a mount assembly by means of burners with upwardly directed flames to the bottom end of the tube, removing the tube from the sealing machine and re-inserting it with its other end at the bottom for the said other end to have its mount assembly sealed thereto. In a horizontal machine the tube is held horizontally and it is possible to seal the mount assemblies to the two tube ends at the same time. From the sealing machine the tubes are transferred to an exhausting machine by means of a further conveyor. There may also be a buffer conveyor between the two machines to cope with unequal rates of output of the two machines. In the exhaust machine the cathodes are activated and all undesirable gases and volatile impurities from the activation are removed from the interior of the lamp, the required amount of mercury and filling gas are introduced and the lamp is finally tipped-off. For activation and tipping-off, the lead-in wires are splayed out to be engageable by an electrical contact-making device and to be out of the way of the usual tipping-off burner. The tubes are then provided with a cap, e.g. a bipin cap, and then the tube is passed to a cap threading machine where the lead-in wires have to be bent to the required position. The caps are then baked on the tube, passed to a pin welding or soldering machine and finally to an ageing machine.

Thus it will be noted that two turrent machines with respectively different heads are employed for sealing and exhausting, and a number of loading, unloading and transfer conveyors are required. The lead-in wires have to be manipulated at least twice, namely at the stage of activation and tipping-off, and finally for cap threading.

Furthermore, during the operation on the exhaust machine the temperature of the lamp has to be relatively high to increase the molecular motion of the gases to assist in removal through the exhaust tube, to desorb gas molecules from the glass envelope or phosphors and to remove by volatilisation moisture and other condensed vapours as well as carbon dioxide which is liberated from the material of the cathodes, usually a tungsten coil coated with earth alkaline carbonates. Thus it will be observed that the whole process has a fairly high energy consumption, yet the heating cycle is rather irrational: the tubes are first heated to a high temperature when the phosphors are baked-on in the lehr, but are allowed to cool down while in the sealing machine and then have to be re-heated for exhausting and cathode activation.

Another important irrationality of present methods and apparatus is that the hot tubes are internally relatively clean and uncontaminated in the lehr but atmospheric and other impurities are allowed free ingress in the sealing machine before sealing. These impurities must then be removed with considerable difficulty in the exhausting machine.

SUMMARY OF THE PRESENT INVENTION

The present invention seeks to overcome, or at least reduce, the above-mentioned drawbacks, and to provide an improved method of, and apparatus for, manufacturing light sources, such as incandescent lamps and fluorescent tubes.

According to one aspect of the present invention, there is provided a head for electric light source making machines, comprising support means for a mount assembly to be sealed in a light source envelope, the mount assembly including an exhaust tube and lead-in wires, sealing burner means for fusing the said mount assembly and the said envelope together, tip-off burner means disposed substantially coaxially with the sealing burner means for tipping-off the exhaust tube so that the lead-in wires of the mount assembly are in use disposed between the sealing burner means and the tip-off burner means, fluid flow coupling means connectable between an external source of gaseous fluid or vacuum and the exhaust tube, and fuel supply means for supplying fuel to said sealing burner means and to said tip-off burner means.

According to another aspect of the present invention, there is provided a head for electric light source making machines comprising sealing burner means for fusing together a light source envelope and a mount assembly that includes an exhaust tube and lead-in wires, tip-off burner means disposed within the sealing burner means and coaxially with the longitudinal axis of the exhaust tube for tipping-off the exhaust tube so that the lead-in wires of the mount assembly are disposed between the sealing burner means and the tip-off burner means, fluid flow duct means connectable between an external source of gaseous fluid or vacuum and the exhaust tube, and fuel supply means for supplying fuel to said sealing burner means and to said tip-off burner means.

The scope of the invention also includes a single-spindle multi-head machine with a turret at either end of the spindle, wherein each head is as set forth above and which is capable of performing mount sealing, cathode activation, exhausting, flushing, filling and tipping-off in one complete revolution of each head.

According to yet another aspect of this invention there is provided a tip-off burner comprising an annular cylindrical body with a fuel passage therein terminating in at least one radially inwardly directed flame-emitting orifice or at least one ring of circumferentially spaced orifices, the radial dimensions of the annular body being so chosen as to allow the tip-off burner to be disposed radially between the exhaust tube of a fluorescent tube or of an incandescent lamp and the maximum radial dimension of the flare.

According to a further aspect of the invention there is provided a method of manufacturing electric light sources, comprising sequentially effecting on each head of a single-spindle multi-head rotary turret or conveyor type machine the steps of sealing a mount assembly to a lamp envelope with the lead-in wires bent to their desired final position for cap threading prior to the sealing step exhausting the interior of the envelope to the required final low pressure and tipping-off the exhaust tube of the mount assembly by means of a tipping-off burner disposed within the sealing burner means and coaxially with the longitudinal axis of the exhaust tube of the mount assembly.

The head may further include electrical contact-making means for engaging the lead-in wires of the mount assembly.

Preferably, a body of electrically insulating material, e.g. in the form of a grooved or apertured refractory sleeve, is coaxially disposed between the sealing burner means and the tip-off burner means.

The apparatus may include means for continuously flushing the interior of a tubular lamp envelope while the phosphor is baked on its inner wall in a lehr, while it is being sealed to the mount assemblies, and for an initial period of cathode activation, until the exhausting stage commences.

The single-spindle turret machine may be of fixed length or of axially adjustable length.

BRIEF DESCRIPTION OF THE DRAWINGS

The invention is described, merely by way of example, with reference to the accompanying diagrammatic drawings in which.

DESCRIPTION OF THE PREFERRED EMBODIMENTS

Figure 1:
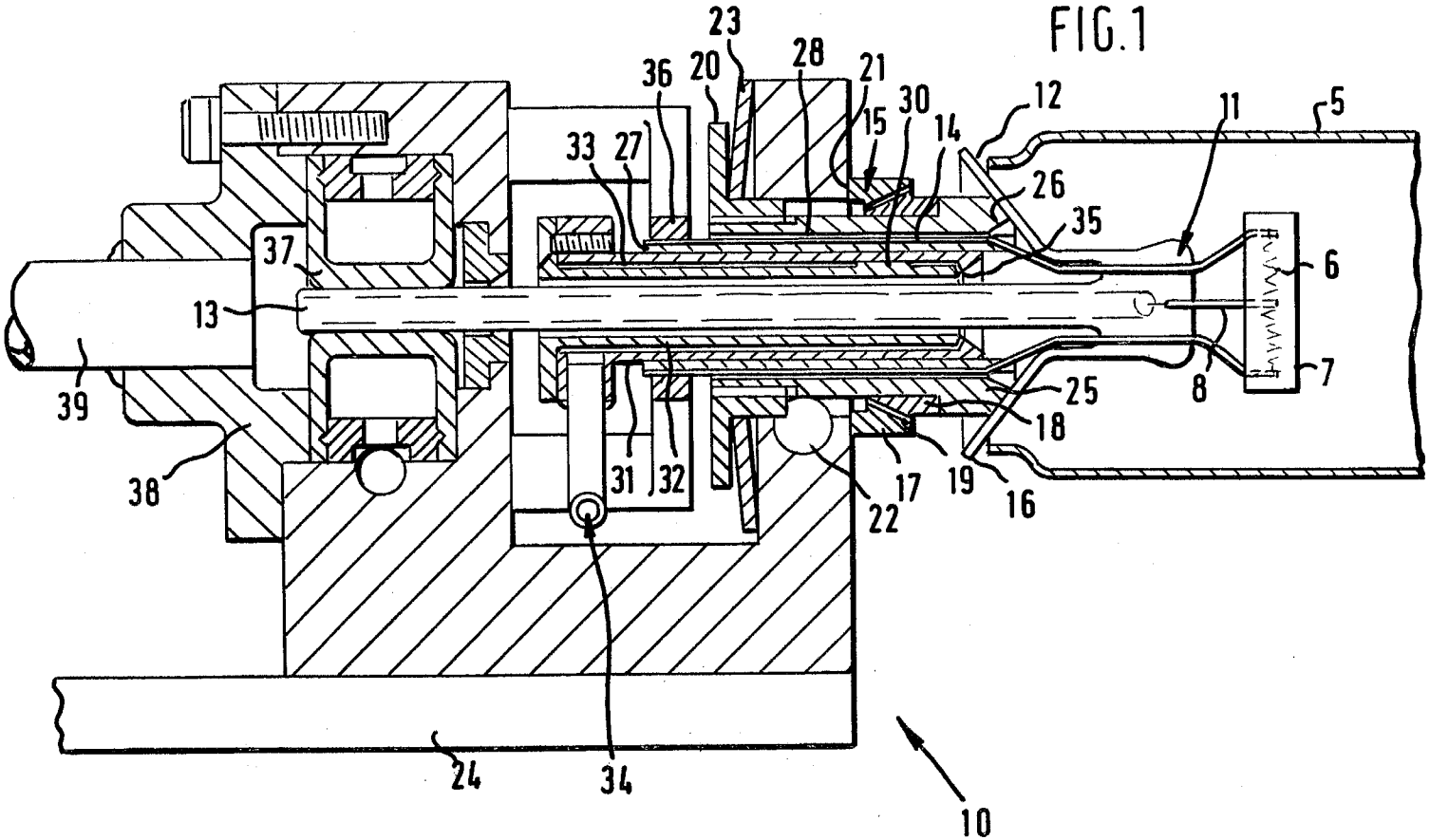
FIG. 1 is a longitudinal cross-section of a head according to the invention for a horizontal, combined sealing/exhausting/tipping-off machine for making fluorescent tubes.

The description with reference to FIG. 1 of the drawings will now proceed on the assumption that the illustrated embodiment is a single-spindle horizontal fluorescent lamp making machine having a respective rotary turret mounted on each end of the spindle. Each turret carries a plurality of identical heads 10 each capable of, sequentially, sealing the flare 12 from the pinch 11 to the end of a tube 5, exhausting the tube envelope, activating the cathode 6 and finally tipping-off the exhaust tube 13.

FIG. 1 also shows the cathode 6 surrounded by an anti-sputtering shield 7 supported from the pinch 11 by way of a stay wire 8; the cathode 6 is connectable to external circuitry via two lead-in wires 14. It is important to note that the lead-in wires 14 have been bent to their desired final position for cap threading in which they extend generally parallel with but spaced from the exhaust tube 13.

The head 10 includes a sealing burner assembly 15 for sealing the edge 16 of the flare 12 to the end of the lamp tubes and comprises annular members 17, 18 defining therebetween a series of angularly spaced flame-emitting orifices 19 for directing an annular, conical, diverging flame to the edge 16. The outer member 17 has a rear shoulder 20 and a front shoulder 21 between which engages a fuel supply pipe 22 held by way of a plate spring 23. The general operation of the sealing burner assembly 15 is well-known to those skilled in the art and will not be described in detail; nor is a seal-working or butting board shown, for the sake of clarity. The head is mounted for axial sliding reciprocating movement on a bed 24.

The inner member 18 is coupled to a sleeve 25 having a frusto-conical nose 26 whch supports and centres the flare 12 during sealing.

The sleeve 25 may be integral with or rigidly connected to an annular body 27 of electrically insulating material so as to define grooves, holes or an annular clearance 28 to accommodate the lead-in wires 14.

A tip-off ring burner 30 is movable (by means not shown) with, as well as axially relative to, the sealing burner assembly 15. The tip-off ring burner 30 has two parallel cylindrical member 31, 32 separated by a radial gap to form a fuel passage 33 connected to a fuel supply pipe 34. The interior of member 32 defines a bore for receiving the exhaust tube 13. The passage 33 extends axially and is then directed radially between nozzle-forming flange-like portions of the members 31, 32 to terminate in an annular, radially inwardly facing ring of spaced apart orifices 35 surrounding the exhaust tube 13 and disposed in substantially the same radial plane as the flare edge 16.

At the rear end of the lead-in wires 14 an electrical contact-making device 36 is disposed. FIG. 1 also shows that the rear end of the exhaust tube 13 is sealingly engaged by a vacuum seal member 37, known as "compression seal" disposed in a fluid coupling body 38 which latter includes a duct 39 connectable via a valve (FIG. 4A) to a source of vacuum or fill gas, as is well-known in the art.

In use, the tip-off burner 30 is inoperative during sealing but helps in engaging and holding the exhaust tube 13; it remains inoperative until towards the end of the exhausting cycle. The capability of the tip-off burner 30 of limited axial movement relative to the sealing burner assembly 15 may be helpful to work the seal so as to improve the quality of the seal.

At a predetermined point of time in the operation of the machine fuel is supplied via the pipe 34 and the passage 33 to the orifices 35 and the fuel is ignited to effect tipping-off of the exhaust tube closely adjacent the stem; in fact, as shown, tipping-off takes place in or within the radial plane of the flare edge 16 to result in a short tip-off stump. Moreover, cathode activation and tipping-off can be effected without requiring further manipulation of the lead-wires which are protected by the body 27.

Figure 4:
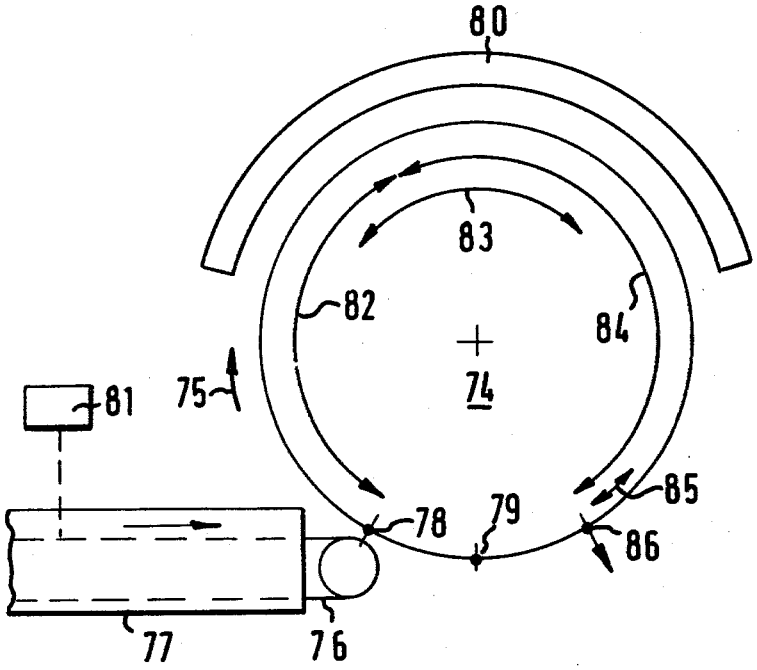
FIG. 4 is a schematic layout of part of a fluorescent lamp making machine group according to this invention, including a plurality of heads shown in FIG. 1.

Although the precise structure is not shown in FIG. 1, (but is schematically indicated in FIG. 4), means are provided for continuously flushing the interior of the lamp tube 5 in the lehr and in the heads 10 described above with an inert gas, e.g. nitrogen, through the phosphor-baking sealing and the initial part of the cathode activation phases of the lamp manufacturing operation.

Figure 2:
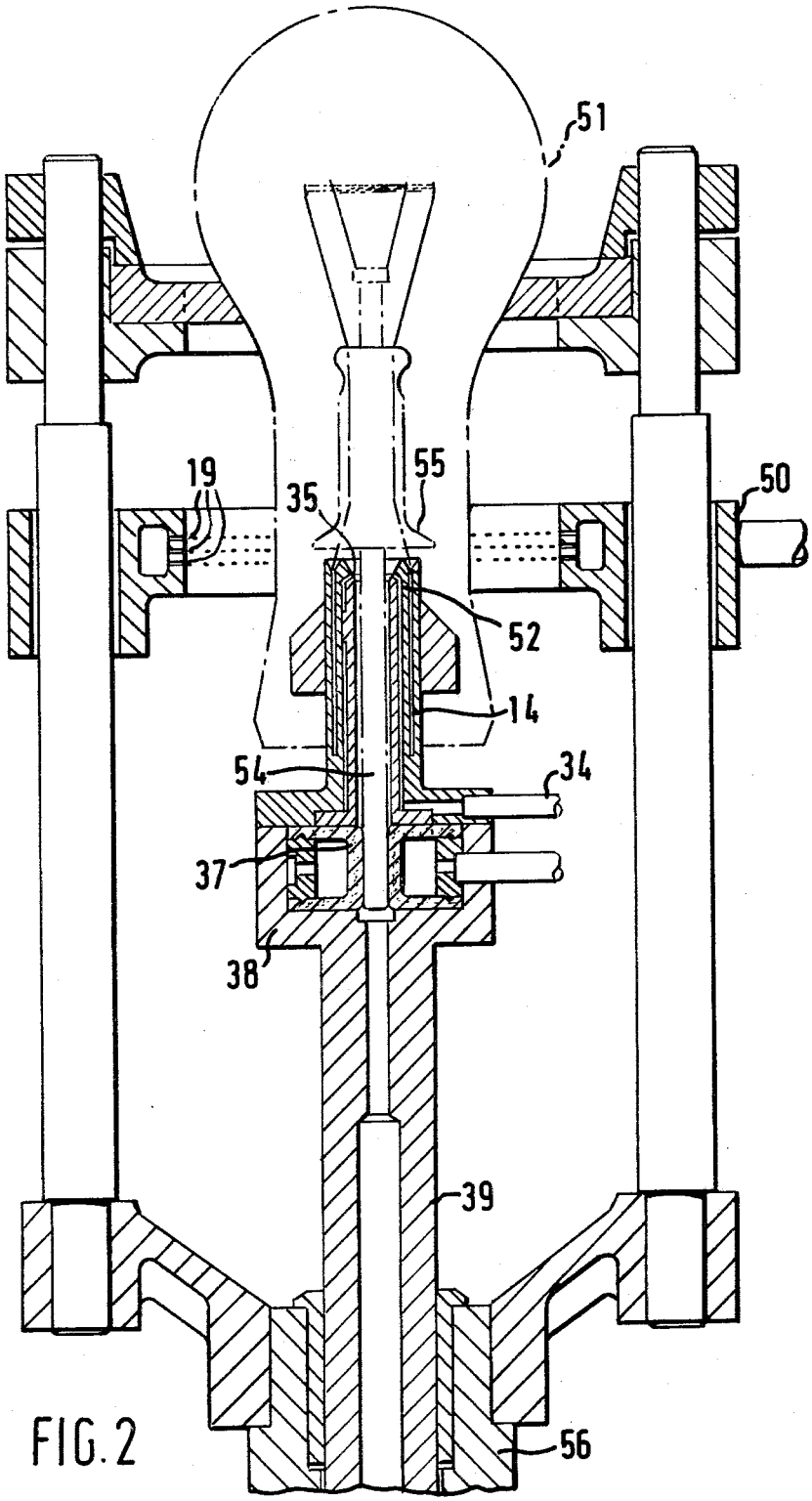
FIG. 2 is a longitudinal cross-sectional view of a head according to the invention, for a combined sealing/exhausting/tipping-off machine for making incandescent lamps.

Referring now to FIG. 2, wherein like reference numbers indicate like or functionally equivalent parts, there is shown an embodiment of the invention applicable to incandescent lamp making machines. In this embodiment the sealing burner ring 50 is disposed externally of the lamp envelope or bulb 51, but the tip-off burner 52 is disposed in the annular space defined between the outer diameter of the exhaust tube 54 and the maximum diameter of the flare 55. The sealing burner ring 50 and the tip-off burner 52 are relatively movably mounted on common support means 56.

Figure 3:
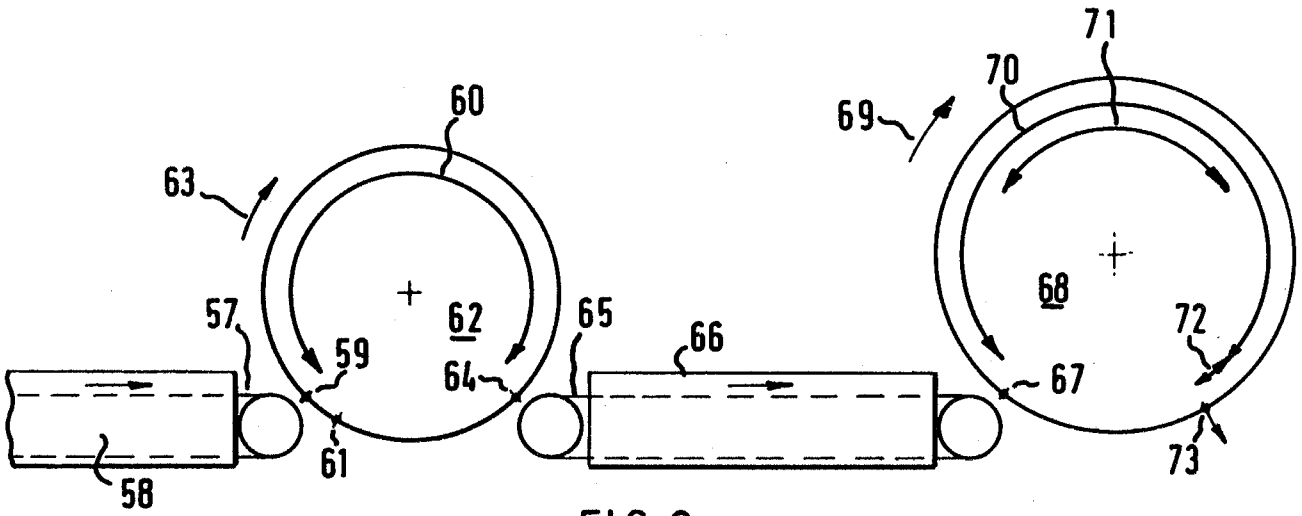
FIG. 3 is a schematic layout of part of a known horizontal florescent lamp making machine group.

The schematic layouts of FIGS. 3 and 4 will serve to highlight the contrast between the prior art and the present invention, respectively, for the case of a horizontal rotary turret fluorescent lamp making machine group.

In FIG. 3, which shows the prior art, hot phosphor-coated tubes arrive on a conveyor 57 from a lehr 58 and are loaded at point 59 on a sealing turret 62 which rotates in the direction of arrow 63. Mount assemblies are loaded on the sealing turret at point 61. Arrow 60 indicates the duration of the sealing stage. The sealed-together tubes and mount assemblies are unloaded at point 64. Between points 59 and 64 the tubes cool down quite significantly and for a considerable portion of the arc between those points the interior of the tubes is accessible to the ingress of impurities from the atmosphere.

At 64 the tubes with mount assemblies are transferred to a conveyor 65 which is passed through a reheating enclosure or zone 66 and are then loaded at 67 on to a turret-type exhausting machine 68 rotating in the direction of arrow 69. In some cases a buffer conveyor may be disposed between the turrets 62 and 68. On the turret 68 the length of the arrows 70, 71 and 72 respectively indicate the duration of the stages (or, the number of heads involved in) pumping and filling, cathode activation and tipping-off. The finished tubes are unloaded at point 73.

In contrast, in FIG. 4 which illustrates the present invention, there is only one turret 74 rotating in the direction of arrow 75. Empty, hot tubes arriving on a conveyor 76 from the lehr 77 are loaded at 78, while the mount assemblies are loaded at 79 on to the turret 74. An arcuate heat shield 80 assists in preserving the high temperature of the tubes while on the turret 74. The fluid coupling 38-39 of FIG. 1 is connected to a source of inert flushing gas, preferably nitrogen, via a valve 81 (see FIG. 4A) while the tubes are in the lehr 77 and on the turret 74. Arrows 82, 83, 84 and 85 respectively indicate the stages of sealing; cathode activation; pumping/flushing/filling; and tipping-off. Unloading takes place at 86. The length of these arrows 82 to 85 is approximately proportional to the duration of these stages, respectively. As can be seen, arrow 83 overlaps arrows 82 and 84 while arrow 85 overlaps arrow 84 to indicate that cathode activation may commence before the end of the sealing process and terminate after the beginning of the flushing/exhausting process, while tipping-off can commence before the filling is finished.

Figure 4A:
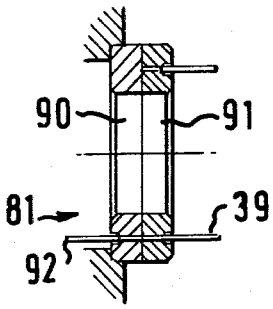
FIG. 4A is an enlarged detail of FIG. 4.

Flushing with nitrogen may continue during the sealing stage 82 and the activation stage 83. During the exhausting stage 84 the valve 81 is disconnected from the source of flushing gas and connected to a vacuum pump (not shown). As can be seen in FIG. 4A, the valve 81 consists of a fixed annular plate 90 and a rotary plate 91 in sealing sliding engagement with the plate 90. The plate 90 has an inlet pipe 92 connectable to a vacuum pump or to a source of fill gas or flushing gas, while the plate 91 has ducts connecting to the pipe 39.

The advantages of the preferred embodiments of the invention are:

(a) elimination of one (turret) machine and reduction in the number of conveyors;

(b) it becomes possible to overlap in time stages or phases of the overall process;

(c) by continuous flushing of the tubes from the lehr to exhausting, impurities are removed as generated, no fresh impurities are allowed into the tube and vacuum pumping is facilitated;

(d) the lead-in wires are initially formed into their correct final shape and position requiring no further manipulation, whereby to eliminate a major source of reject product;

(e) energy can be saved by the reduction of heat losses from the phosphor-baking to the exhausting stages;

(f) cathode activation becomes easier and more certain by the elimination of the need for the electrical contact-making device to "hunt" for the lead-in wires; and (g) the head according to the invention may be used also in conjunction with fluorescent lamps embodying the most recent developments in mercury dispensing; and (h) the head according to the invention may be used also in conjunction with lamps of the type comprising a sealed and evacuated bulbous outer envelope the inside wall of which is provided with a fluorescent material, the envelope including a re-entrant portion or well of substantial depth in relation to its overall size and sized to accommodate therein electrical means for exciting the fluorescent material, wherein an aperture is formed at, or adjacent to, the bottom of the well, an exhaust tube is sealed to the well, the envelope is pumped out to the required pressure and filled with a predetermined amount of mercury and an inert gas.

We claim as our invention:

1. A head for electric light source making machines, said head comprising support means for a mount assembly to be sealed in a light source envelope wherein the mount assembly is of the type including an exhaust tube and lead-in wires, said support means including a bore for receiving a mount assembly exhaust tube, said bore having a longitudinal axis; sealing burner means carried by said support means for fusing a mount assembly and an envelope together, said sealing burner means extending about the bore and being generally centered on said longitudinal axis; tip-off burner means disposed substantially coaxially with and surrounding said bore for tipping-off an exhaust tube with lead-in wires of the mount assembly disposed between said sealing burner means and said tip-off burner means and generally parallel with said longitudinal axis of said bore, said tip-off burner means being radially fixing with respect to said longitudinal axis and relative to said sealing burner means, fluid flow coupling means connectable between an external source of gaseous fluid or vacuum and the exhaust tube, and fuel supply means for supplying fuel to said sealing burner means and to said tip-off burner means.

2. A head for electric light source making machines, said head comprising sealing burner means for fusing together a light source envelope and a mount assembly that includes an exhaust tube having a longitudinal axis and lead-in wires; support means for positioning the longitudinal axis of the exhaust tube carried thereby, said sealing burner means being disposed around the intended position of an exhaust tube longitudinal axis; tip-off burner means radially fixedly disposed within the sealing burner means and coaxially with the intended position of the longitudinal axis of the exhaust tube for tipping off the exhaust tube so that the lead-in wires of the mount assembly are disposed between the sealing burner means and the tip-off burner means, fluid flow duct means connectable between an external source of gaseous fluid or vacuum and the exhaust tube, and fuel supply means for supplying fuel to said sealing burner means and to said tip-off burner means.

3. A head according to claim 2 further comprising electrical contact-making means for engaging the lead-in wires of the mount assembly.

4. A head according to claim 2 further comprising a body of electrically insulating material disposed between the sealing burner means and the tip-off burner means.

5. A head according to claim 4 wherein said body is formed with aperture means to accommodate the lead-in wires therein.

6. A head according to claim 2 wherein the tip-off burner means is movable relative to the sealing burner means.

7. A head according to claim 2 wherein the tip-off burner means and the sealing burner means are each reciprocatingly and mutually independently movably mounted on a base.

8. A head according to claim 2 wherein the electric light source is an elongated tubular fluorescent lamp and the tip-off burner means is dimensioned and constructed to operate in the annular space defined by the outer diameter of the exhaust tube and the maximum diameter of the flare.

9. An electric light source making machine comprising a plurality of heads each of which as claimed in claim 2, further including valve means connected to said duct means to control the interior atmosphere of the light source envelope, the valve means being selectably operable to connect the interior of said envelope to a vacuum pump, a source of flushing gas or a source of fill gas.

10. A machine according to claim 9 in which the machine is a horizontal, single-spindle, rotary turret-type fluorescent lamp making machine wherein there is a turret at each end of said spindle, and further including a generally sector-shaped heat shield disposed around the turrets.

* * * * *

UNITED STATES PATENT AND TRADEMARK OFFICE

CERTIFICATE OF CORRECTION

PATENT NO. : 4,184,728

DATED : January 22, 1980

INVENTOR(S) : JULIAN P. GRENFELL and STANLEY W. STEPHENS

It is certified that error appears in the above-identified patent and that said Letters Patent are hereby corrected as shown below:

Column 7, line 23, "fixing" should read -- fixed --.

Signed and Sealed this

*Twenty-fifth* Day of *March 1980*

[SEAL]

*Attest:*

SIDNEY A. DIAMOND

*Attesting Officer*

*Commissioner of Patents and Trademarks*